US007287447B2

(12) United States Patent
Pettit, Jr.

(10) Patent No.: US 7,287,447 B2
(45) Date of Patent: Oct. 30, 2007

(54) FASTENER INSTALLATION TOOL

(76) Inventor: Jack E. Pettit, Jr., P.O. Box 67, Genoa, NV (US) 89411

( * ) Notice: Subject to any disclaimer, the term of this patent is extended or adjusted under 35 U.S.C. 154(b) by 0 days.

(21) Appl. No.: 11/531,844

(22) Filed: Sep. 14, 2006

(65) Prior Publication Data

US 2007/0107557 A1 May 17, 2007

Related U.S. Application Data

(60) Provisional application No. 60/736,932, filed on Nov. 14, 2005.

(51) Int. Cl.
*B25B 33/00* (2006.01)
*B25B 13/48* (2006.01)
*B25B 21/00* (2006.01)

(52) U.S. Cl. ..... 81/56; 81/55

(58) Field of Classification Search ..... 81/55, 81/56, 57.14

See application file for complete search history.

(56) References Cited

U.S. PATENT DOCUMENTS 5,109,735 A * 5/1992 Hart ..... 81/56
5,305,666 A * 4/1994 LaTorre ..... 81/55
5,553,519 A 9/1996 Pettit, Jr.
6,935,209 B2 * 8/2005 Lantow et al. ..... 81/55
6,959,625 B2 11/2005 Pettit, Jr.
2004/0177724 A1 * 9/2004 Pettit, Jr. ..... 81/55

* cited by examiner

*Primary Examiner*—David B Thomas
(74) *Attorney, Agent, or Firm*—Kelly Lowry & Kelley, LLP; Stuart O. Lowry

(57) ABSTRACT

An improved fastener installation tool is provided of the type having a fixture pin for seated reception into a mating recess at the shank end of a threaded fastener, while a power-driven tool socket installs a threaded nut onto the fastener shank. The installation tool includes an improved spring-loaded clutch unit for normally supporting the fixture pin against rotation, but permitting fixture pin rotation in response to a torque load exceeding a predetermined limit thereby preventing fixture pin breakage. The clutch unit is adapted for quick and easy disengagement from the fixture pin, and pivotal displacement to an out-of-the-way position to permit quick and easy fixture pin removal and replacement.

18 Claims, 8 Drawing Sheets

FASTENER INSTALLATION TOOL

BACKGROUND OF THE INVENTION

This invention relates generally to improvements in power tools used in the installation of threaded fasteners, particularly specialized threaded fasteners of the type used in aerospace and related industries. More specifically, this invention relates an improved fastener installation tool of the type described in U.S. Pat. No. 5,553,519 having a power-driven socket for installing a threaded nut onto a threaded fastener, a fixture pin for normally retaining the threaded fastener against rotation during nut installation, and a clutch mechanism for permitting fixture pin rotation in response to a torque overload condition thereby preventing fixture pin breakage. The improved fastener installation tool incorporates an improved clutch unit adapted for quick and easy fixture pin disengagement, and displacement to an out-of-the-way position to permit quick and easy fixture pin removal and replacement.

A variety of specialized fasteners have been developed and are widely used in the aerospace and related industries, wherein these threaded fasteners have been designed to meet specific design criteria and uses. One example of a specialized aerospace fastener comprises a so-called "Eddie" bolt in the form of a threaded bolt adapted for power-driven installation of a threaded nut onto a threaded shank, without requiring access to the bolt head. That is, such fasteners are designed to fit through a preformed opening in a substrate or other structure with the bolt head inaccessibly disposed at a blind side thereof. The bolt shank protrudes through the substrate opening with a threaded shank end exposed for screw-on installation of a threaded nut. The shank end is formed to include a small shallow recess of typically hexagonal cross section for receiving a mating fixture pin designed to hold the bolt against rotation as the threaded nut is installed. Power-driven installation tools are known for use in installing such fasteners, including a small fixture pin disposed coaxially within a power-driven socket for installing the threaded nut while the fixture pin holds the bolt against rotation.

In a typical fastener application, using a power-driven installation tool of the type described above, the fixture pin engages and supports the fastener shank, and progressively retracts within the power-driven socket as the threaded nut is rotatably advanced onto the threaded bolt shank. At least some friction between the bolt and the substrate assists the fixture pin in retaining the bolt against rotation during nut installation. In recent years, however, particularly with the advent of composite material substrates in aircraft, friction contributes minimally to bolt retention during nut installation, and this is especially true when the substrate opening is coated or lined with a sealant material having a typical low coefficient of friction. Accordingly, on some occasions, the fixture pin is the only structure preventing bolt rotation during nut installation. Torque loads between the power-driven nut and the bolt can sometimes be transmitted directly to the fixture pin, resulting in over-torqueing and breakage of the fixture pin. When this occurs, it has been necessary to remove the installation tool from service for appropriate repair or replacement.

U.S. Pat. No. 5,553,519 discloses an improved fastener installation tool wherein the fixture pin is carried by a spring-loaded clutch to prevent a fixture pin torque overload condition. More particularly, the fixture pin is carried by a cam wheel having an externally toothed or lobed configuration defining detent seats engaged by a spring-loaded cam pin. During normal operation, the cam pin retains the cam wheel and fixture pin against rotation, thereby also retaining the bolt shank engaged with the fixture pin. However, in the event of a torque overload condition, the cam pin springably retracts to permit limited rotation of the cam wheel and fixture pin sufficient to protect the fixture pin against torque overload damage.

While this above-described fastener installation tool with spring-loaded clutch provides a significant advance in the art by effectively safeguarding the fixture pin against torque damage, the assembled components do not facilitate quick and easy access to the fixture pin. That is, portions of the clutch assembly must be disassembled in order to access the fixture pin as may be periodically required, for example, to interchange fixture pins of different sizes suitable for engaging and retaining bolts of different sizes.

Accordingly, there exists a need for further improvements in and to fastener installation tools of the type having a fixture pin carried by a torque overload clutch, wherein the fixture pin can be accessed quickly and easily and without any significant disassembly of tool components, to facilitate fixture pin removal and replacement. The present invention fulfills these needs and provides further related advantages.

SUMMARY OF THE INVENTION

In accordance with the invention, an improved fastener installation tool is provided of the type having a fixture pin for seated reception into a mating recess at the shank end of a threaded fastener, while a power-driven tool socket installs a threaded nut onto the fastener shank. The installation tool further includes an improved torque overload clutch unit for normally supporting the fixture pin against rotation, but permitting fixture pin rotation in response to a torque load exceeding a predetermined limit thereby preventing fixture pin breakage. The improved clutch unit is adapted for quick and easy disengagement from the fixture pin, and pivotal displacement to an out-of-the-way position to permit quick and easy fixture pin removal and replacement.

In a preferred form, the installation tool comprises a tool head having an elongated fixture pin mounted coaxially within a rotatable socket associated with a drive means for power-drive socket rotation. The fixture pin is longitudinally movable within the power-driven socket for retraction therein as the power-driven socket advances a threaded nut onto the threaded shank of a fastener, such as a bolt. The fixture pin includes a tip having a noncircular, preferably hexagonal cross section for seated reception into a mating recess formed in the shank end of the fastener, to support and retain the fastener against rotation during thread-on nut installation.

The improved clutch unit is carried by the installation tool head, and normally engages and constrains the fixture pin against rotational displacement in the course of power-driven socket rotation for thread-on mounting of the nut. The clutch unit comprises a compact cartridge which is movably mounted onto the tool head, with a cam wheel engaging and normally retaining the fixture pin against rotation. In the preferred form, the cam wheel includes a shallow socket cavity of noncircular, preferably hexagonal cross section for mating reception of a similarly-shaped key formed on a rear end of the fixture pin for normally retaining said fixture pin against rotation. The cam wheel further defines a lobed perimeter including a plurality of radially outwardly open detent seats, with a cam lever urged by an adjustable force cam spring into engagement with one of said detent seats. When the fixture pin is subjected to a torque load of sufficient magnitude as predeterminably set by the adjustable cam spring, the cam lever retracts to permit cam wheel and associated fixture pin rotation sufficient to safeguard the fixture pin against torque overload damage. A rearwardly open calibration port in the cam wheel accommodates engagement by a torque wrench to confirm and test the maximum torque load as set by the cam spring.

[The clutch unit or cartridge is movably mounted onto the tool head by a lost motion pivot coupling that accommodates rearward displacement of the cam wheel with the fixture pin, as the power-driven socket is rotatably driven to advance the threaded nut onto the fastener shank. In this regard, the pivot coupling has sufficient lost motion or freedom of movement relative to the tool head, and in a generally radial direction relative to the cam wheel, to maintain the cam wheel substantially coaxially aligned with the fixture pin at all times. The key at the rear end of the fixture pin preferably incorporates contoured or rounded-edge drive surfaces engaged with the cam wheel socket cavity to accommodate a small degree of angular cam wheel displacement relative to a longitudinal axis of the fixture pin.

[The pivotally mounted clutch unit or cartridge is normally retained or biased in a forward position, with the cam wheel socket cavity receiving and supporting the key at the rear end of the fixture pin, by means of a clamp spring such as a leaf spring or the like. In the preferred form, the leaf spring is pivotally carried on the tool head for displacement between a first or normal position engaging a rearward face of the clutch unit, for forwardly biasing the clutch unit into cam wheel engagement with the fixture pin key. As the power-driven socket is rotatably driven to advance the threaded nut onto the fastener shank, the leaf spring accommodates rearward clutch unit pivotal displacement without interruption of the applied forward-directed biasing force.

The leaf spring can be pivoted laterally on the tool head to a second out-of-the-way position to permit simple rearward pivoting of the clutch unit to displace the cam wheel away from the fixture pin. This exposes the fixture pin for easy access and slide-out removal from the tool head, if desired, followed by quick and easy slide-in installation of a replacement fixture pin.

Other features and advantages of the present invention will become apparent from the following more detailed description, taken in connection with the accompanying drawing which illustrate, by way of example, the principals of the present invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
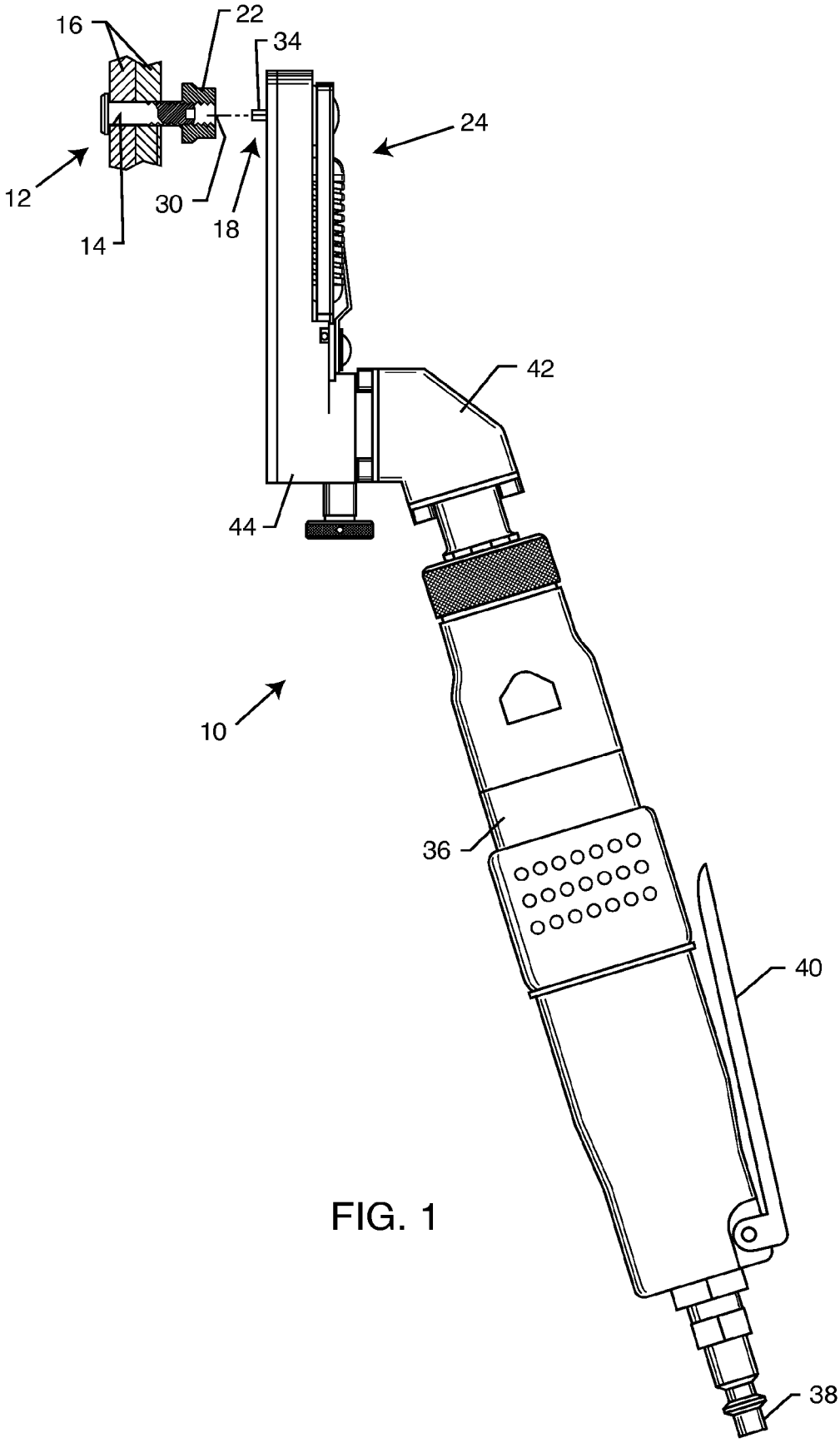
FIG. 1 is a side elevation view of an improved fastener installation tool constructed in accordance with one preferred form of the invention, and showing the installation tool in exploded relation with a threaded fastener of the type having a threaded shank with a recess of noncircular cross-sectional shape formed in said threaded shank.

As shown in the exemplary drawings, an improved installation tool referred to generally in FIG. 1 by the reference numeral 10 is provided for installing a threaded fastener 12 in a position extending through a port or opening 14 formed in one or more substrates 16 such as a pair of overlying panel structures or the like. The installation tool 10 includes a relatively small fixture pin 18 for engaging and retaining the fastener against rotation as a power-driven socket 20 (FIGS. 5-6) rotatably installs a threaded nut 22 onto the fastener 12, in combination with an improved spring-loaded clutch unit 24 for safeguarding the fixture pin 18 against torque overload damage. In accordance with a primary aspect of the invention, this clutch unit 24 is movably mounted in a manner to accommodate quick and easy fixture pin access for removal and replacement, without requiring any significant disassembly of tool components.

The illustrative threaded fastener 12 represents a specialized fastener commonly referred to as an "Eddie" bolt, and used extensively in aerospace and related industries. More specifically, as shown best in FIGS. 1, 5 and 6, the fastener 12 comprises an elongated and externally threaded bolt shank 26 joined at one end to an enlarged bolt head 28. The threaded shank 26 has a size and shape for slide-fit reception through the port or ports 14 formed in the substrate or substrates 16, with the bolt head 28 disposed at a substantially inaccessible or blind side of the substrate(s). A recess 30 is formed in the leading end or tip of the threaded bolt shank 26, wherein this recess 30 has a noncircular and preferably hexagonal cross sectional shape. In some installations, a sealant material 32 (FIG. 5) may be used for sealing passage of the fastener 12 through the substrate(s) 16, wherein the presence of such sealant material 32 substantially reduces friction between the fastener 12 and the adjacent substrate surfaces.

The installation tool 10 may be constructed generally in accordance with U.S. Pat. No. 5,553,519, which is incorporated by reference herein, and further includes the improved clutch unit 24. The installation tool 10 includes the fixture pin 18 having a leading or tip end 34 with a noncircular and preferably hexagonal cross sectional shape for mating slide-fit reception into the fastener shank recess 30, to support and retain the fastener 12 against rotation as the power-driven socket 20 installs the threaded nut 22 onto the fastener shank 26. During such power-driven nut installation, the clutch unit 24 safeguards the fixture pin 18 against torque overload damage such as breakage or bending attributable to occasional and typically brief intervals during which substantial torque loads can be transmitted from the power-driven socket 20 via the nut 22 and fastener shank 26 to the fixture pin 18. The clutch unit 24 protects against such damage to the fixture pin 18 by allowing fixture pin rotation in response to a torque load exceeding a predetermined torque limit.

Figure 2:
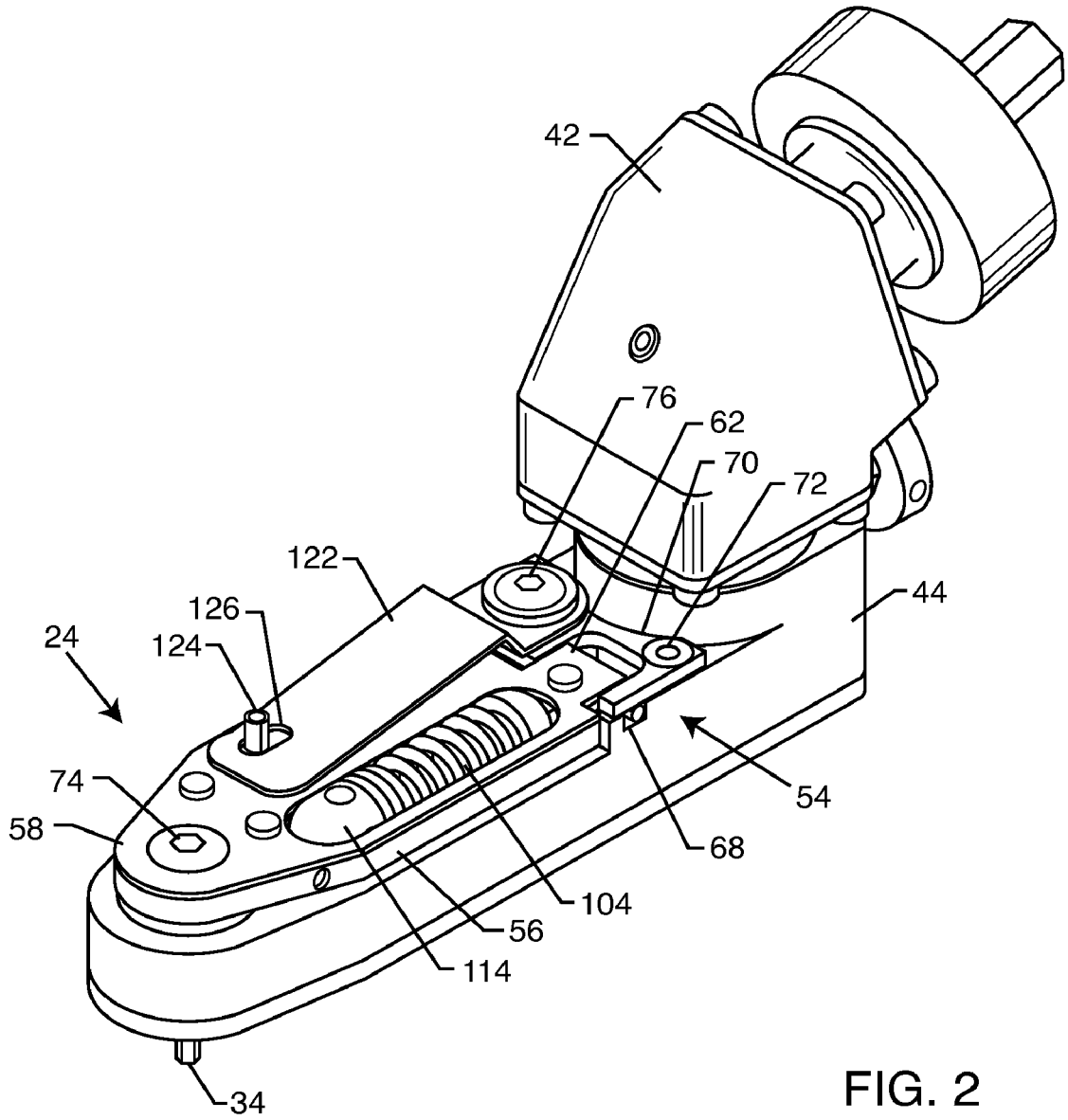
FIG. 2 is an enlarged and fragmented rear perspective elevation view of a portion of the installation tool.

As shown generally in FIG. 1, the installation tool 10 comprises a relatively compact tool housing or body 36 designed for hand-held gripping and manipulation, and including an inlet fitting 38 for suitable coupling to a drive power source (not shown) such as a conventional pneumatic source. A trigger 40 on the tool body 36 can be manually depressed for coupling the power source to internal rotary drive components (also not shown) to produce a rotary drive output. As depicted generally in FIGS. 1-3, this rotary drive output is coupled through an angularly oriented adapter 42 to a tool head 44. Gear train components mounted within the tool head 44 cause an output gear 46 (FIGS. 5-6) to be rotatably driven at a controlled fixed or variable speed. The illustrative drawings show this output gear 46 to include a shaped inner diameter for integrally defining the power-driven socket 20. Alternatively, it will be understood that the driven gear 46 may be adapted for removable mounting of a traditional socket wrench structure of the type shown and described in U.S. Pat. No. 5,553,519. In either configuration, as is known in the art, the power-driven socket 20 defines internal drive surfaces for engaging and rotatably driving the threaded nut 22 of mating size and shape, for purposes of power-drive installation of the nut 22 onto the threaded shank 26 of the fastener 12.

Figure 5:
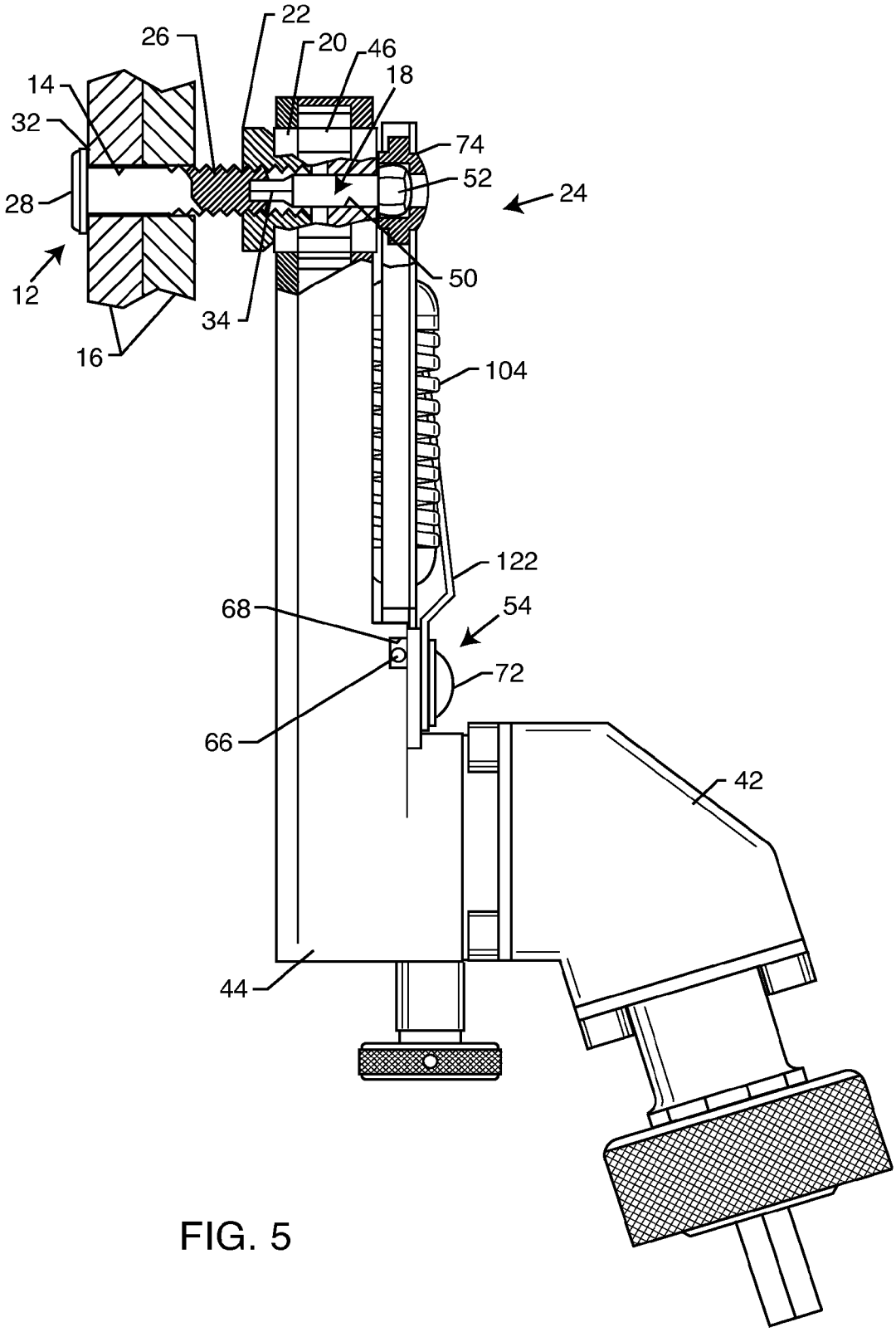
FIG. 5 is a side elevation view, similar to FIG. 1, but depicting initial drive engagement between the installation tool and the threaded fastener, with portions of the drive tool being broken away to illustrate construction details thereof.
Figure 6:
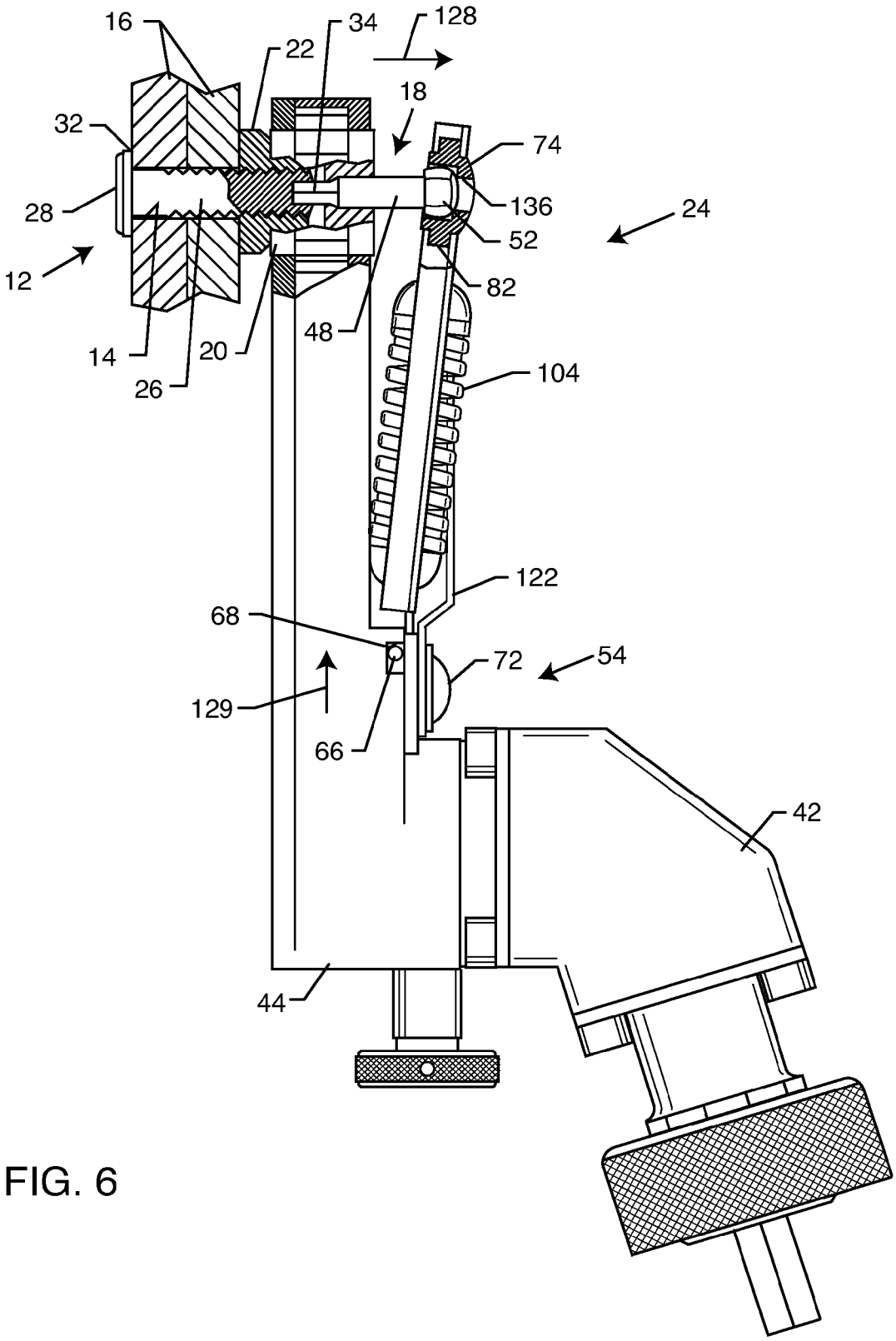
FIG. 6 is a side elevation view, similar to FIG. 5, but showing final drive engagement between the installation tool and the threaded fastener.
Figure 7:
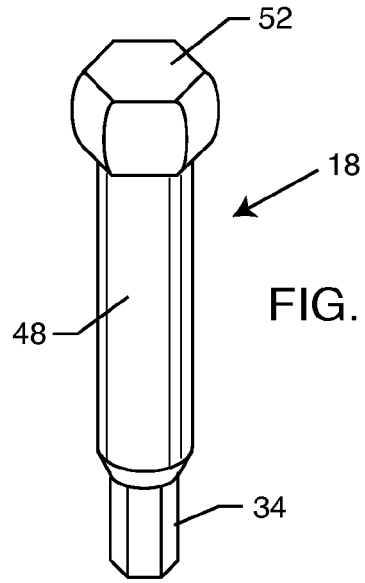
FIG. 7 is an enlarged rear perspective view of an exemplary fixture pin for use in the improved installation tool.
Figure 8:
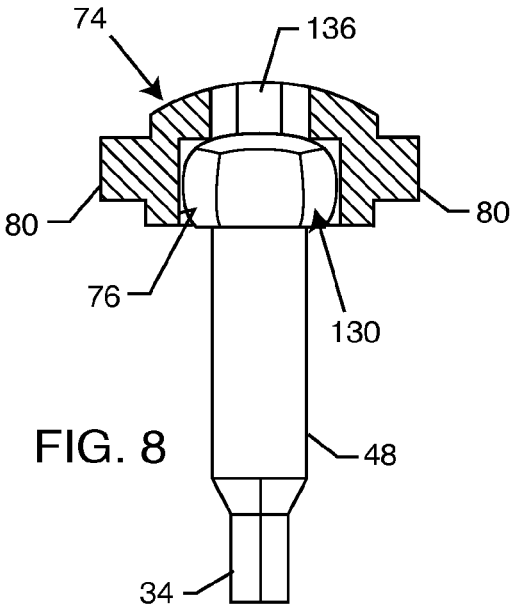
FIG. 8 is an enlarged side elevation view of the fixture pin, shown assembled with a cam wheel forming a portion of the improved clutch unit and depicted in vertical section, wherein the orientation between the fixture pin and cam wheel correspond with initial drive engagement between the installation tool and the threaded fastener as viewed in FIG. 5.
Figure 9:
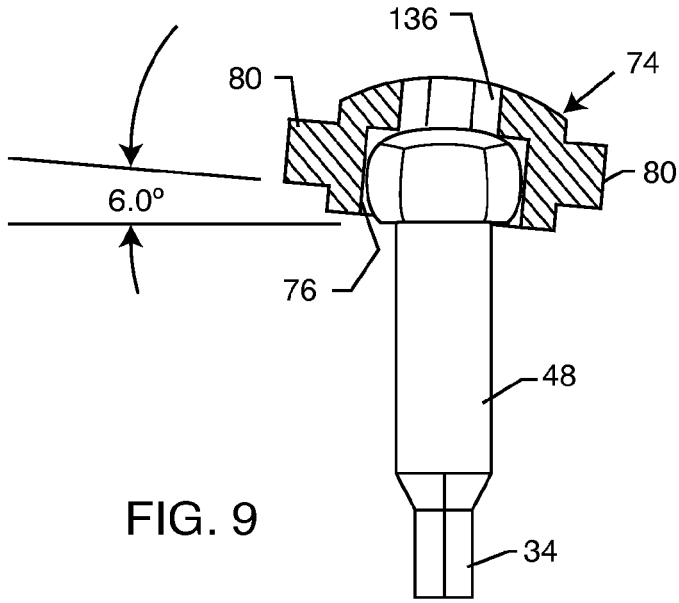
FIG. 9 is a side elevation view, shown partially in vertical section, similar to FIG. 8, but illustrating final drive engagement between the installation tool and the threaded fastener as viewed in FIG. 6.

The fixture pin 18 (shown best in FIG. 7) comprises an elongated member having the noncircular and preferably hexagonal leading or tip end 34 joined with a central or intermediate pin segment or pin shank 48 having a circular cross sectional shape for slide-fit reception into a central bore 50 formed in the socket 20 (FIGS. 5-6). The diametric size of the tip end 34 is less than the diametric size of the central pin segment 48, so that the fixture pin 18 can be slide-fit inserted into and through the socket bore 50. The trailing or rear end of the fixture pin 18 includes a key 52 of noncircular and preferably hexagonal shape, wherein this key 52 has a diametric size somewhat greater than the size of the socket bore 50 to prevent slide-fit displacement therethrough. Thus, with this construction, the tip end 34 of the fixture pin 18 can be fitted forwardly through the socket bore 50, to orient the central pin segment or shank 48 generally within said socket bore 50, and further to orient the rear-end key 52 at a position disposed behind the socket bore 50. In operation, the socket bore 50 provides an effective bearing or bushing for supporting the fixture pin 18 while permitting rotation of the socket 20 relative to the fixture pin.

The clutch unit 24 is movably mounted onto the tool head 44 at the aft or rear side thereof. In general terms, the clutch unit 24 engages the key 52 at the rear end of the fixture pin 18 to support and retain the fixture pin 18 against rotation. However, the clutch unit 24 is adjustably set to permit rotation of the fixture pin 18 if and when the fixture pin is subjected to a torque load exceeding a predetermined limit, whereby the clutch unit 24 effectively safeguards the fixture pin 18 against torque overload damage. In addition, the clutch unit 24 can be quickly and easily disengaged from the fixture pin 18 in a manner exposing the fixture pin for easy access and facilitated slide-out removal from the tool head 44 for replacement, all without requiring any significant disassembly of the clutch unit 24 or other tool components.

Figure 3:
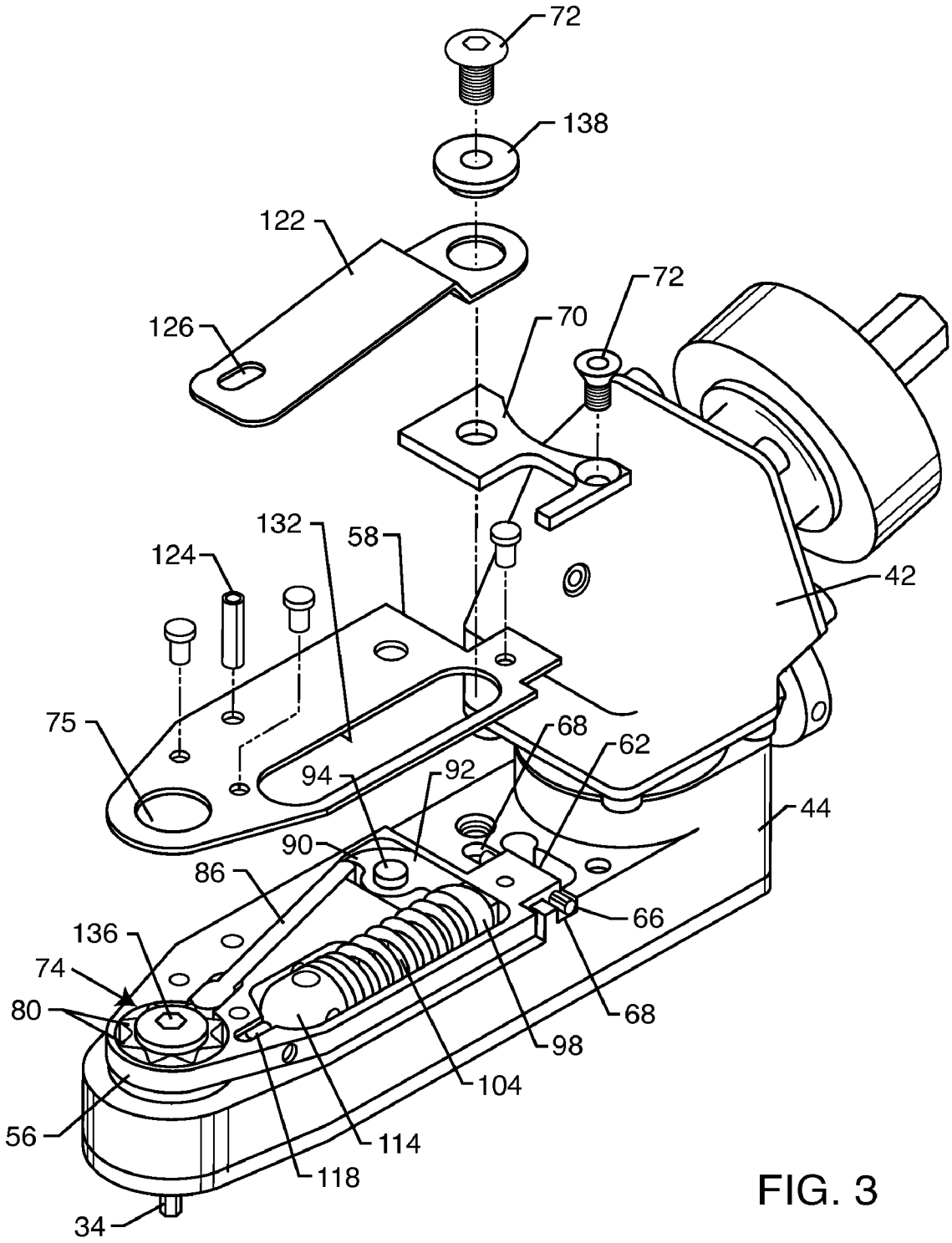
FIG. 3 is an enlarged, fragmented and partially exploded rear perspective view of the installation tool.
Figure 4:
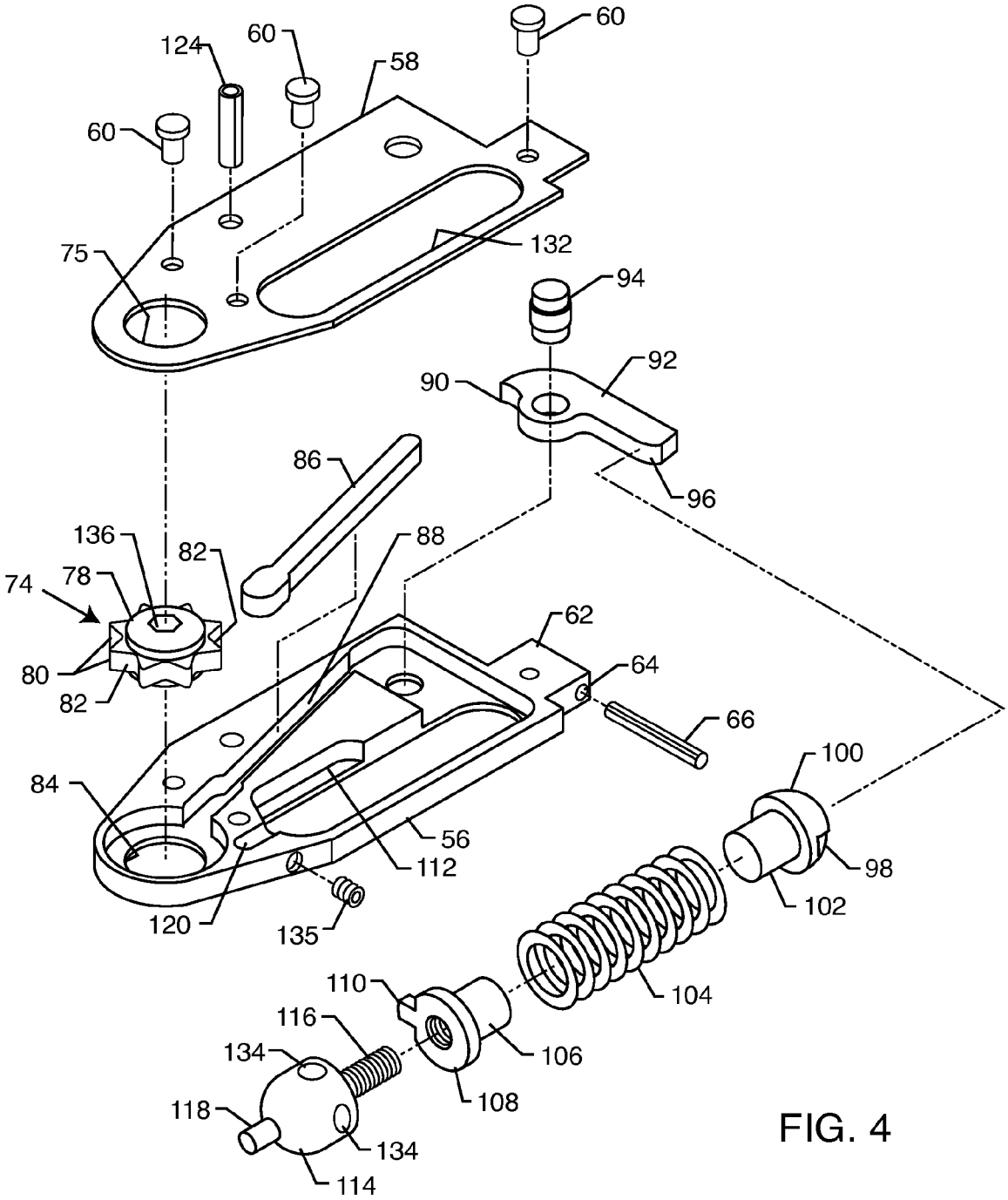
FIG. 4 is an enlarged and exploded perspective view of an improved clutch unit.

More particularly, the clutch unit 24 comprises a compact cartridge adapted for pivotal mounting onto the tool head 44 by means of a lost motion coupling 54. This clutch cartridge comprises a housing base 56 defining a contoured and rearwardly presented internal housing chamber shaped to receive and support clutch components, and assembled with a rear-side housing plate 58 mounted thereto by suitable fasteners 60 such as rivets or screws (FIGS. 3-4). A downwardly protruding tab 62 on the housing base 56 includes a transversely open port 64 for slide-fit reception of a pivot pin 66 having a length sufficient to extend outwardly a short distance from the opposite ends of the tab port 64. These protruding opposite ends of the pivot pin 66 are seated respectively within open-sided pivot slots 68 formed on the tool head 44 at a rear side thereof (FIG. 3). A clamp bracket 70 is fastened by screws 72 or the like onto the tool head 44 in a position overlying these slots 68, thereby retaining the pivot pin 66 within the pivot slots 68. Accordingly, a first or lower end of the clutch unit 24 is mounted onto the tool head 44 for pivoting movement generally about the axis of the pivot pin 66 within the pivot slots 68, thereby accommodating pivoting motion of the opposite second or upper end of the clutch unit 24 forwardly toward and rearwardly away from the tool head 44.

The clutch unit 24 includes a cam wheel 74 for normally engaging the rear-end key 52 on the fixture pin 18, to support and retain the fixture pin against rotation. This cam wheel 74 (FIGS. 3-4 and 8-9) comprises a generally circular or disk-shaped element having a forwardly open socket cavity 76 formed with a noncircular and preferably hexagonal cross sectional shape for substantially mating reception and support of the fixture pin key 52. A rear end face 78 is provided for at least partially closing this socket cavity 76 to preclude rearward sliding movement of the key 52 through the cam wheel 74. The cam wheel 74 further defines a lobed perimeter including a plurality of radially outwardly protruding cam teeth 80 separated by a corresponding plurality of radially outwardly open detent seats 82. The cam wheel 74 and the perimeter teeth 80 thereon are axially constrained between the housing base 56 and plate 58 of the clutch unit cartridge 24, with the housing base 56 including a forwardly open aperture 84 (FIG. 4) for receiving the fixture pin key 52 into engagement with the cam wheel socket cavity 76.

An elongated clutch member in the form of a cam lever 86 is slidably carried within the clutch unit cartridge, as by slidably fitting the cam lever 86 within an elongated channel 88 formed in the housing base 56. One end of this cam lever is sized and shaped for seated reception into an aligned one of the multiple detent seats 82 on the cam wheel 74. An opposite end of the cam lever 86 abuts a first cam surface 90 on a crank link 92 which is pivotally supported within the cartridge as by means of a pivot pin 94. A second cam surface 96 defined at an opposite end of the crank link 92 is fitted within a notch 98 of a spring guide 100, which in turn includes a short plug 102 seated within one end of an elongated coil-type cam spring 104. An opposite end of this cam spring 104 carries a short plug 106 of an internally threaded spring adjustment nut 108. The adjustment nut 108 includes a radially outwardly projecting wing 110 carried in an elongated guide track 112 defined by the housing base 56 to preclude adjustment nut rotation relative thereto, while permitting adjustment nut translation in a longitudinal direction relative to a long axis of the cam spring 104. Such longitudinal nut translation is achieved by means of an adjuster block 114 having a threaded rod 116 carrying the threaded adjustment nut 108, and a bushing pin 118 rotatably supported within a bearing seat 120 defined by the housing base 56.

With this construction, the cam spring 104 reacts between the adjustment nut 108 and the second cam surface 96 of the crank link 92, to apply to spring force urging the second cam surface 96 in a downward direction away from the cam wheel 74. The crank link 92 pivots on the pivot pin 94 to convert this cam spring force with mechanical advantage to urge the cam lever 86 upwardly with the upper end thereof urged into seated engagement with the aligned detent seat 82 on the cam wheel 74. Accordingly, the cam lever 86 springably engages and retains the cam wheel 74 against rotation. Since the cam wheel 74 is normally engaged with the fixture pin key 52, the cam wheel 74 normally supports and retains the fixture pin 18 against rotation.

In this regard, a clamp member such as a clamp spring 122 is provided at the exterior of the clutch unit or cartridge 24, for normally applying a forwardly directed force on the pivotally mounted clutch unit for purposes of normally urging and retaining the cam wheel 74 in a first position in engagement with the fixture pin key 52. This clamp spring 122, in the illustrative preferred form of the invention, may comprise an elongated plate-like leaf spring (FIGS. 2-6 and 10) having a base or lower end secured to the tool head 44 by a screw or the like, such as one of the screws 72 used to install the clamp bracket 70. An upper or opposite end of the leaf spring 122 extends upwardly along the rear face of the housing plate 58, and is contoured for applying the desired forwardly directed spring force to the clutch unit cartridge. A retainer post 124 may be mounted on the housing plate 58 to protrude rearwardly therefrom, for normal reception into a lock port 126 in the leaf spring 122 thereby normally retaining the leaf spring in engagement with the clutch unit cartridge.

In operation, the socket 20 on the tool head 44 carries the threaded nut 22 of appropriate size for power-drive thread-on engagement with the fastener 12. The fixture pin 18 is initially seated and engaged with the fastener shank tip recess 30, whereupon the tool trigger 40 is depressed to initiate rotary driving of the socket 20. In this initial position, the leaf spring 122 urges the clutch unit cartridge 24 forwardly into abutting contact with a rear side or rear face of the tool head 44, as shown in FIG. 5. In this position, the clutch unit cartridge 24 is thus oriented substantially perpendicular to a central axis of the fixture pin 18, the socket 20, the nut 22, and the shank 26 of the fastener. The cam wheel 74 is thus also oriented substantially perpendicular to a central axis of the fixture pin 18, as viewed best in FIG. 8.

As the nut 22 is threadably installed onto the fastener shank 26 upon power-driven rotation of the socket 20, the nut 22 and socket 20 are advanced toward the substrate(s) 16, and forwardly relative to the fixture pin 18 and associated tip 34 thereof which remains seated within the fastener tip recess 30. During such relative advancing movement of the socket 20, the fixture pin 18 undergoes relative rearward displacement through a short stroke within the rotating socket. FIG. 6 illustrates the fixture pin 18 in a rearmost displaced position, with the socket 20 in a forwardmost displaced position upon completion of power-drive nut installation onto the fastener. Importantly, such rearward relative displacement of the fixture pin 18 bears against the end face 78 of the cam wheel 74 and thereby causes the entire clutch unit cartridge 24 to pivot rearwardly about the axis of the lower pivot pin 66. In a typical installation, the clutch unit 24 will pivot rearwardly through a short angular stroke of about 6 degrees, as viewed in FIG. 9.

In accordance with one aspect of the invention, the lost motion coupling 54 comprising the pivot pin 66 retained within the slots 68 accommodates clutch unit shifting to maintain a central axis of the cam wheel 74 aligned substantially coaxially with a central axis of the fixture pin 18, despite clutch unit displacement through the above-described rearward angular stroke. That is, as viewed in FIGS. 5-6, the pivot slots 68 permit rearward shifting of the clutch unit 24 relative to the tool head 44, as indicated by arrow 128, as the clutch unit 24 pivots rearwardly in the course of installing the nut 22 onto the fastener 12. At the same time, the pivot slots 68 are sufficiently elongated to permit the pivot pin 66 to ride upwardly within the slots 68, as indicated by arrow 129, for maintaining the cam wheel 74 aligned substantially coaxially with the fixture pin 18. In this regard, such rearward pivoting movement of the clutch unit 24 is accompanied by slight angular cocking of the cam wheel 74 relative to the fixture pin 18 (FIG. 9) through a similar small angular stroke of typically about 6 degrees, wherein the flat-drive surfaces of the mated key 52 can incorporate a slight contour or curvature as indicated by arrow 130 (FIG. 8) to preclude binding between these components.

Throughout the entire procedure, the leaf-type clamp spring 122 maintains the forward-bias force on the clutch unit 24 for purposes of maintaining the cam wheel 74 in engagement with the key 52 at the rear end of the fixture pin 18. The lock port 126 in the leaf spring 122 is suitable elongated to accommodate this angular displacement of the clutch unit 24. Upon completion of nut installation, the tool 10 is manually retracted from the fastener 12 and installed nut 22, and may then be employed for power-drive installation of another nut onto a subsequent fastener.

In the event of a torque overload condition, i.e., a condition applying an excess torque to the fixture pin 18, the cam lever 86 springably retracts from the lobed cam wheel 74 to permit at least limited cam wheel and associated fixture pin rotation. In a typical torque overload condition of relatively short or transient duration, rotation of the cam wheel 74 through a partial revolution corresponding with one or a small number of detent seats 82 is sufficient to safeguard the fixture pin 18 against torque overload damage.

In accordance with a further aspect of the invention, the spring force applied by the cam spring 104 can be adjustably set to provide close control over the maximum permitted fixture pin torque load. In this regard, the spring adjuster block 114 is rearwardly exposed through a window 132 (FIGS. 3-4) formed in the housing plate 58, and includes a circumferentially spaced plurality of shallow drive ports 134 opening in a radially outward direction. These drive ports 134 are thus externally exposed for access with a wrench (not shown) or the like used to rotate the adjuster block 114 through part-circle rotational strokes. Such rotation of the adjuster block 114 is accompanied by rotation of the threaded rod 116 thereon, to correspondingly translate the adjustment nut 108 within the limits of the track 112 to selectively compress or otherwise permit elongation of the cam spring 104. This effectively increases or decreases the cam spring force applied to the cam wheel 74, and thereby effectively increases or decreases the maximum permitted torque load before cam lever retraction to permit cam wheel rotation. A set screw 135 (FIG. 4) can be provided for releasibly locking the adjuster block 114 in a desired set position.

The cam wheel 74 beneficially includes a small rearwardly open calibration port 136 formed in the end face 78 thereof, and exposed rearwardly through an opening 75 (FIGS. 3-4) formed in the clutch unit housing plate 58. This calibration port 136 is of noncircular and preferably hexagonal shape, and is sized to receive a tip end of a suitable calibration tool such as a torque wrench (not shown) so that the cam wheel 74 may be manually rotated while observing or noting the requisite torque load required for such cam wheel rotation. The force applied by the cam spring 104 can then be adjusted as needed to achieve a selected predetermined torque load release point. Such calibration and adjustment of the applied cam spring force can be carried out without requiring disassembly of an tool head or clutch unit components.

Figure 10:
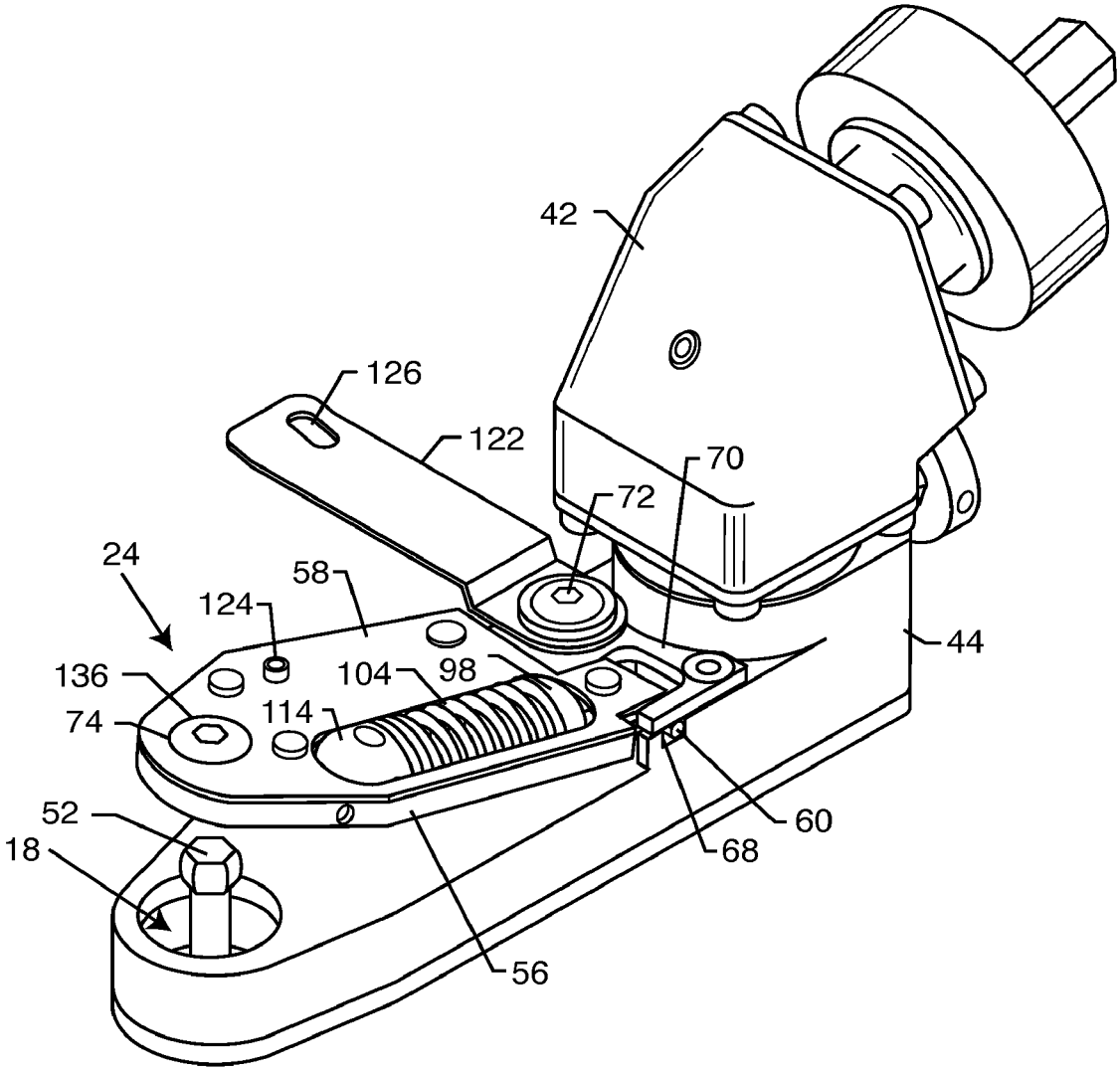
FIG. 10 is a rear perspective view similar to FIG. 2, but illustrating rearwardly pivoted manipulation of the improved clutch unit to accommodate access to the fixture pin for removal and/or replacement.

When access to the fixture pin 18 is desired for removal and/or replacement thereof, e.g., such as when an alternative or replacement fixture pin 18 having a tip 34 of different size suitable for use with a fastener of different size is required, the leaf spring 122 is swung laterally to an out-of-the-way position as viewed in FIG. 10. In particular, the leaf spring 122 is rearwardly displaced through a short and sufficient stroke to clear the rearmost end of the retainer post 124, whereupon the leaf spring 122 can then be displaced through a lateral pivoting movement about the axis of the associated mounting screw 72. In this regard, a low friction bushing 138 (FIG. 3) may be carried by the associated mounting screw 72 to accommodate easy swinging displacement of the leaf spring 122. In the out-of-the-way position as viewed in FIG. 10, the leaf spring 122 does not obstruct free rearward pivoting of the clutch unit cartridge 24 toward a rearwardly displaced second position with the cam wheel 74 disengaged from the fixture pin key 52. The fixture pin 18 is thus rearwardly exposed for quick and easy slide-out removal from the tool head 44, followed by slide-in reinstallation of the same or a replacement fixture pin. Disassembly of tool head and/or clutch unit components is not required.

Although various embodiments and alternatives have been described in detail for purposes of illustration, various further modifications may be made without departing from the scope and spirit of the invention. Accordingly, no limitation on the invention is intended by way of the foregoing description and accompanying drawings, except as set forth in the appended claims.

What is claimed is:

1. A fastener installation tool, comprising:

a tool head;

a socket carried by said tool head for receiving and supporting a threaded nut;

drive means for rotatably driving said socket to install the nut onto a threaded fastener;

a fixture pin carried by said tool head generally coaxially within said socket for longitudinal sliding displacement therein as the nut is installed onto the threaded fastener, said fixture pin having a front tip end for engaging and retaining the threaded fastener to prevent fastener rotation during thread-on installation of the nut, said fixture pin further having a key of noncircular cross section formed thereon;

a clutch unit comprising a cartridge mounted on said tool head for movement between a first position engageable with said key and including a spring-loaded clutch member for normally preventing rotation of said fixture pin within said socket, said clutch unit in said first position permitting rotation of said fixture pin within said socket in response to a torque load applied to said fixture pin in excess of a predetermined limit, whereby said clutch unit safeguards said fixture pin against breakage in response to a torque overload condition;

said clutch unit being further movable to a second position disengaged from said key for facilitated access to said fixture pin for removal and replacement; and a clamp member for releasibly retaining said clutch unit normally in said first position, said clamp member comprising a spring mounted on said tool head and movable between a normal position releasibly retaining said clutch unit in said first position, and an out-of-the-way position permitting clutch unit movement to said second position.

2. The fastener installation tool of claim 1 wherein said clamp member comprises a leaf spring.

3. The fastener installation tool of claim 1 wherein said clutch unit is pivotally mounted on said tool head for swinging movement between said first and second positions.

4. The fastener installation tool of claim 1 wherein said key comprises a generally hexagonal cross sectional shape.

5. A fastener installation tool, comprising:

a tool head;

a socket carried by said tool head for receiving and supporting a threaded nut;

drive means for rotatably driving said socket to install the nut onto a threaded fastener;

a fixture pin carried by said tool head generally coaxially within said socket for longitudinal sliding displacement therein as the nut is installed onto the threaded fastener, said fixture pin having a front tip end for engaging and retaining the threaded fastener to prevent fastener rotation during thread-on installation of the nut, said fixture pin further having a key of noncircular cross section formed thereon; and a clutch unit comprising a cartridge mounted on said tool head for movement between a first position engageable with said key and including a spring-loaded clutch member for normally preventing rotation of said fixture pin within said socket, said clutch unit in said first position permitting rotation of said fixture pin within said socket in response to a torque load applied to said fixture pin in excess of a predetermined limit, whereby said clutch unit safeguards said fixture pin against breakage in response to a torque overload condition;

said clutch unit being further movable to a second position disengaged from said key for facilitated access to said fixture pin for removal and replacement;

said clutch unit being pivotally mounted on said tool head by a lost motion coupling for swinging movement between said first and second positions.

6. A fastener installation tool, comprising:

a tool head;

a socket carried by said tool head for receiving and supporting a threaded nut;

drive means for rotatably driving said socket to install the nut onto a threaded fastener;

a fixture pin carried by said tool head generally coaxially within said socket for longitudinal sliding displacement therein as the nut is installed onto the threaded fastener, said fixture pin having a front tip end for engaging and retaining the threaded fastener to prevent fastener rotation during thread-on installation of the nut, said fixture pin further having a key of noncircular cross section formed thereon; and a clutch unit comprising a cartridge mounted on said tool head for movement between a first position engageable with said key and including a spring-loaded clutch member for normally preventing rotation of said fixture pin within said socket, said clutch unit in said first position permitting rotation of said fixture pin within said socket in response to a torque load applied to said fixture pin in excess of a predetermined limit, whereby said clutch unit safeguards said fixture pin against breakage in response to a torque overload condition;

said clutch unit being further movable to a second position disengaged from said key for facilitated access to said fixture pin for removal and replacement;

said fixture pin comprising an elongated shank having said front tip end, said key on said fixture pin being formed generally at a rear end of said shank and having a comparatively larger diametric size, and further wherein said fixture pin shank is slide-fit receivable into a socket bore defined by said tool head with said key disposed generally behind the socket bore, said fixture pin key being exposed and accessible for rearward slide-out removal of said fixture pin when said clutch unit is in said second position;

said clutch unit comprising an externally lobed cam wheel defining externally open detent seats, said cam wheel further having an open-sided socket cavity formed therein and defining a generally noncircular cross sectional shape for substantially mated reception and support of said fixture pin key, said clutch unit further comprising a spring-loaded clutch member engageable with one of said detent seats for normally retaining said cam wheel and said fixture pin against rotation, said clutch member being springably retractable from said detent seats to permit rotation of said cam wheel and said fixture pin in response to a torque overload condition.

7. The fastener installation tool of claim 6 further including a spring member for applying a spring force to said clutch member, and means for adjustably selecting the magnitude of said spring force applied to said clutch member.

8. The fastener installation tool of claim 7 wherein said cam wheel further includes a calibration port of noncircular cross section for receiving a calibration tool for manually rotating said cam wheel.

9. The fastener installation tool of claim 7 wherein said spring member comprises a coil spring, and further wherein said means for adjustably setting the magnitude of said spring force comprises an adjustment nut carried at one end of said coil spring and constrained against rotation, an opposite end of said coil spring applying said spring force to said clutch member, and a rotatable adjuster block for axially adjusting the position said adjustment nut relative to said coil spring.

10. The fastener installation tool of claim 9 wherein said clutch member comprises a crank link pivotally carried by said clutch unit and having opposite ends thereon respectively engaged by said coil spring and by a cam lever engageable with one of said cam wheel detent seats.

11. The fastener installation tool of claim 6 wherein said clutch unit is pivotally mounted on said tool head by a lost motion coupling for swinging movement between said first and second positions, said lost motion coupling accommodating rearward angular displacement of said clutch unit through a short angular stroke while retaining said cam wheel substantially in coaxial alignment with said fixture pin as the nut is threadably installed onto the threaded fastener.

12. The fastener installation tool of claim 11 wherein said key further defines curvedly contoured surfaces to prevent binding with said cam wheel as the nut is threadably installed onto the threaded fastener.

13. A fastener installation tool, comprising:

a tool head;

a socket carried by said tool head for receiving and supporting a threaded nut;

drive means for rotatably driving said socket to install the nut onto a threaded fastener;

a fixture pin carried by said tool head generally coaxially with respect to said socket, said fixture pin having a front tip end for engaging and retaining the threaded fastener to prevent fastener rotation during thread-on installation of the nut, said fixture pin further having an elongated shank carried within a socket bore formed in said tool head for longitudinal sliding movement therein, and a key of noncircular cross section formed generally at a rear end of said fixture pin, said key having a diametric size larger than said fixture pin shank;

a clutch unit comprising a cartridge mounted by a lost motion coupling on said tool head for pivoting movement between a first position engageable with said key and including a spring-loaded clutch member for normally preventing rotation of said fixture pin within said socket, said clutch unit in said first position permitting rotation of said fixture pin within said socket in response to a torque load applied to said fixture pin in excess of a predetermined limit, whereby said clutch unit safeguards said fixture pin against breakage in response to a torque overload condition;

said lost motion coupling accommodating rearward angular displacement of said clutch unit in said first position through a short angular stroke while retaining said cam wheel substantially in coaxial alignment with said fixture pin as the nut is threadably installed onto the threaded fastener;

said clutch unit being further movable to a second position disengaged from said key for facilitated access to said fixture pin for removable and replacement; and a clamp member for releasibly retaining said clutch unit normally in said first position.

14. The fastener installation tool of claim 13 wherein said clamp member comprises a leaf spring mounted on said tool head and movable between a normal position releasibly retaining said clutch unit in said first position, and an out-of-the-way position permitting pivotal movement of said clutch unit to said second position, said fixture pin key being exposed and accessible for rearward slide-out removal of said fixture pin when said clutch unit is in said second position.

15. The fastener installation tool of claim 14 wherein said clutch unit comprises an externally lobed cam wheel defining externally open detent seats, said cam wheel further having an open-sided socket cavity formed therein and defining a generally noncircular cross sectional shape for substantially mated reception and support of said fixture pin key, said clutch unit further comprising a spring-loaded clutch member engageable with one of said detent seats for normally retaining said cam wheel and said fixture pin against rotation, said clutch member being springably retractable from said detent seats to permit rotation of said cam wheel and said fixture pin in response to a torque overload condition.

16. The fastener installation tool of claim 15 further including a spring member for applying a spring force to said clutch member, and means for adjustably selecting the magnitude of said spring force applied to said clutch member.

17. The fastener installation tool of claim 16 wherein said cam wheel further includes a calibration port of noncircular cross section for receiving a calibration tool for manually rotating said cam wheel.

18. The fastener installation tool of claim 16 wherein said spring member comprises a coil spring, and further wherein said means for adjustably setting the magnitude of said spring force comprises an adjustment nut carried at one end of said coil spring and constrained against rotation, an opposite end of said coil spring applying said spring force to said clutch member, and a rotatable adjuster block for axially adjusting the position said adjustment nut relative to said coil spring.

* * * * *